US007622868B2

(12) United States Patent
Baarman et al.

(10) Patent No.: US 7,622,868 B2
(45) Date of Patent: Nov. 24, 2009

(54) INDUCTIVELY POWERED GAS DISCHARGE LAMP

(75) Inventors: David W. Baarman, Fennville, MI (US); John James Lord, Springfield, IL (US); Nathan P. Stien, West Des Moines, IA (US); Wesley J. Bachman, Auburn, IL (US)

(73) Assignee: Access Business Group International LLC, Ada, MI (US)

( * ) Notice: Subject to any disclaimer, the term of this patent is extended or adjusted under 35 U.S.C. 154(b) by 191 days.

(21) Appl. No.: 11/461,475

(22) Filed: Aug. 1, 2006

(65) Prior Publication Data

US 2007/0029936 A1 Feb. 8, 2007

Related U.S. Application Data

(60) Provisional application No. 60/705,012, filed on Aug. 3, 2005.

(51) Int. Cl.
*H01J 13/46* (2006.01)

(52) U.S. Cl. ..... 315/49; 315/115; 315/114; 315/46; 315/64

(58) Field of Classification Search ..... 315/112–118, 315/40–71
See application file for complete search history.

(56) References Cited

U.S. PATENT DOCUMENTS 3,935,502 A * 1/1976 Herzog ..... 315/94
4,082,981 A 4/1978 Morton et al.
4,150,323 A * 4/1979 Yeh et al. ..... 315/209 R
4,560,908 A 12/1985 Stupp et al.
6,771,024 B2 8/2004 Sudou
6,917,372 B1 7/2005 Yokoyama
6,936,967 B2 8/2005 Van Den Bogert
6,940,232 B1 9/2005 Kong
6,952,081 B1 10/2005 Jansma
2002/0067137 A1 * 6/2002 Okubo et al. ..... 315/209 R
2003/0057866 A1 * 3/2003 Takahashi et al. ..... 315/219
2003/0201731 A1 10/2003 Baarman

FOREIGN PATENT DOCUMENTS

EP 1422978 A1 5/2004
JP 06325882 A 11/1994

* cited by examiner

*Primary Examiner*—Tuyet Vo
(74) *Attorney, Agent, or Firm*—Warner Norcross & Judd LLP

(57) ABSTRACT

An inductively powered gas discharge lamp including both a power coil and a heating coils associated with each filament. The heating coils enable the filaments to be preheated before the starting voltage is applied through the power coils. The inductive power coils and the inductive heater coils are contained within the lamp envelope, allowing the lamp to be entirely sealed. A method of dimming the lamp also is disclosed. The lamp is dimmed by both decreasing the power applied to the power coils and increasing the power applied to the heating coils so as to prevent the arc from extinguishing under lower voltage conditions.

3 Claims, 4 Drawing Sheets

INDUCTIVELY POWERED GAS DISCHARGE LAMP

PRIORITY CLAIM

This application claims priority from U.S. Provisional Application No. 60/705,012, filed Aug. 3, 2005, entitled "COIL ARRANGEMENT FOR A GAS DISCHARGE LAMP".

BACKGROUND OF THE INVENTION

Gas discharge lamps are extremely popular for providing lighting. For example, they are used in offices, homes, factories, auditoriums, and airliners.

One of the most functional types of gas discharge lamps is inductively powered as described in U.S. Pat. No. 6,731,071, entitled "Inductively Powered Lamp Assembly." This lamp includes a coil within the lamp envelope for powering each filament or electrode. Each coil is inductively coupled to a power source within the fixture. Optionally, the lamp filaments are provided with a preheat circuit to preheat the filaments before the lamp is started. The circuit includes a switch that is closed to provide preheat current to the filament. After the lamp filament is heated sufficiently, the switch is opened to provide voltage for striking the lamp.

In lamps that are not inductively powered (i.e. that include conventional contact pins extending from the lamp envelope), heating of the lamp filaments is common. Heating of the filaments reduces the voltage required to strike the lamp and to maintain the illumination of the lamp. Additionally, heating of the lamp filaments allows for increased control of dimmability of the lamp. Changing the intensity of a fluorescent lamp requires changing the voltage applied to the lamp. However, reduction in the voltage applied to a lamp reduces the current passing through the filaments of the lamp, thereby changing the temperature of the lamp filaments. If the filament temperature falls too low, the lamp will extinguish because of an inability to maintain the arc between the filaments. Accordingly, ballast circuits have been developed for dimming fluorescent lamps by increasing the current through the filaments as the voltage to the lamp is decreased. These circuits enable the lamp to be dimmed over a greater range. Unfortunately, this approach is not directly adaptable to inductively powered lamps.

An inductively powered gas discharge lamp having an ability to provide filament heating is desired.

SUMMARY OF THE INVENTION

The aforementioned problems are overcome by a gas discharge lamp that includes power inductive coils for powering the lamp, and heating inductive coils for heating the lamp filaments or electrodes. As disclosed, first and second power coils provide power to the first and second filaments of the lamp in conventional fashion. Additionally, first and second heater coils provide heating current to the first and second electrodes to enable the filaments to be preheated before the striking voltage is applied to the filaments through the power coils.

In a further aspect of the invention, the power coils and the heating coils are controlled in a coordinated fashion to provide dimming. The voltage applied to the electrodes through the power coils is inversely proportional to the current applied to the electrodes through the heating coils. Accordingly, the lamp is both inductively powered and dimmable.

These and other objects, advantages, and features of the invention will be more fully understood and appreciated by reference to the description of the current embodiment and the drawings.

DESCRIPTION OF THE CURRENT EMBODIMENT

Figure 1:
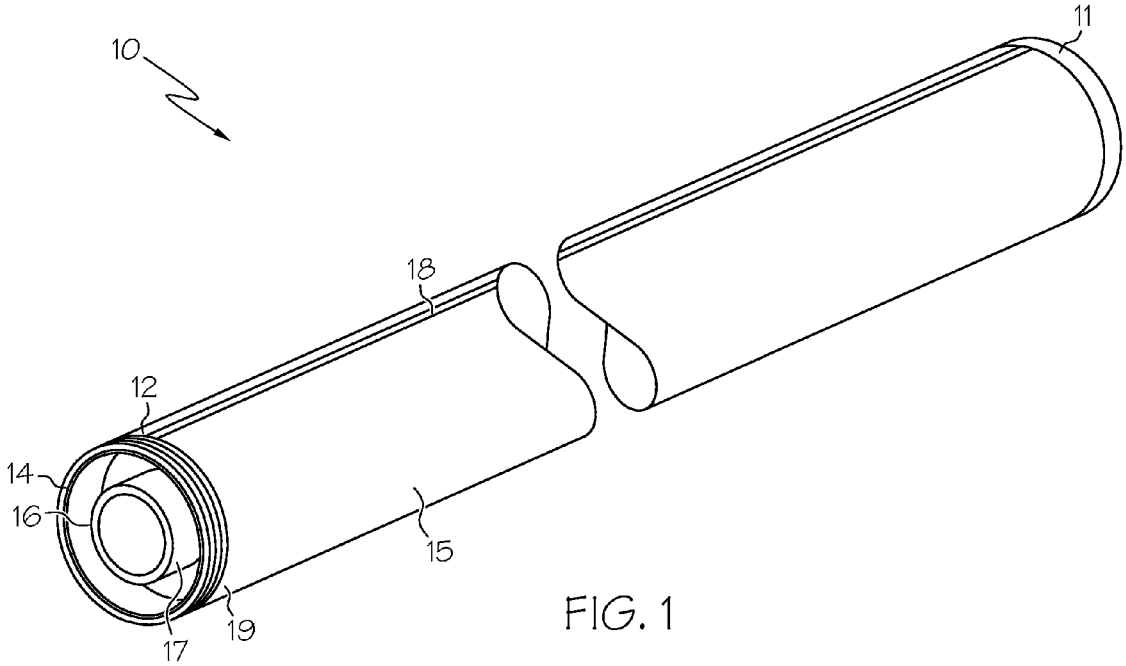
FIG. 1 is an inductively coupled gas discharge lamp.

A gas discharge lamp constructed in accordance with a current embodiment of the invention is illustrated in the drawings and designated 10.

As shown in FIG. 1, the lamp 10 has a pair of inductive connector sections 11, 12 on an envelope 15. The inductive connector section 12 has a power coil 14 and a heater coil 16. The inductive connector section 11 is similar to that of the inductive connector sector 12. The conductive strip 18 connects the inductive connector section 11 to the inductive connector section 12. Although the illustrated physical embodiment of the lamp 10 is a linear tube, the lamp can take any variety of physical configurations as known to those in the art.

The conductor 18 is formed on the interior of lamp 10. According to one embodiment, the conductor 18 is a strip of conductive paint applied to the inside of the lamp 10. According to another embodiment, the conductor 18 is a metallic strip attached to the inside of the lamp 10 with an adhesive. A layer of insulating material could then be applied over the conductor 18. Alternatively, the conductor 18 could be a conductive wire extending from the inductive connector section 11 to the inductive connector section 12, either on the inside of the lamp 10, or along the outside of the lamp 10.

When the inductive connector sections 11, 12 are formed entirely within the lamp 10, then the lamp 10 can be fully sealed. Alternatively, the inductor connector sections 11, 12 could be placed onto a lamp tube in a manner similar to that used for the end connectors of a conventional gas discharge lamp.

Figure 2:
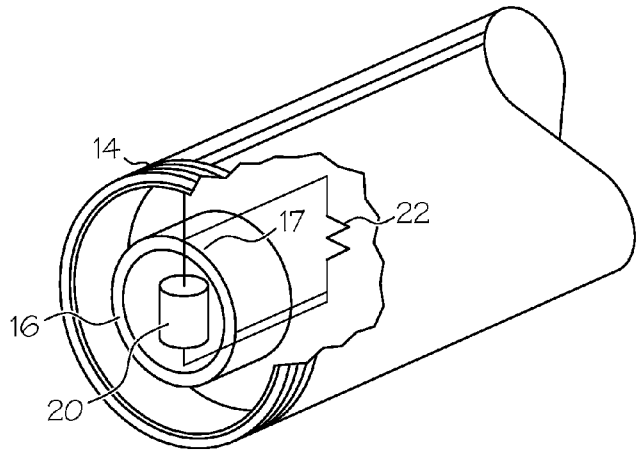
FIG. 2 shows an inductive connector section of a gas discharge lamp.

The inductive connector section 12 is shown in more detail in FIG. 2. The power coil 14 is connected to the heater coil 16 by way of the capacitor 20. The heater coil 16 is connected to a lamp filament 22.

Figure 3:
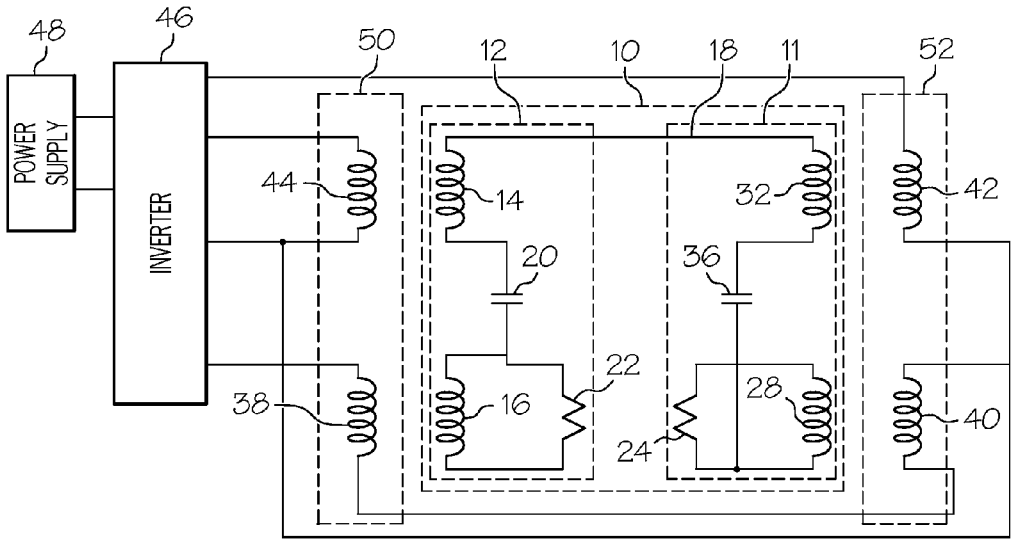
FIG. 3 shows an electrical schematic diagram of a gas discharge lamp and a lamp fixture.

FIG. 3 shows an electrical schematic diagram for the lamp 10 within a lamp fixture. The lamp filaments 22, 24 are connected in series with the heater coils 16, 28. The power coils 14, 32 are connected to the filaments 22, 24 by way of the capacitors 20, 36. The power coils 14, 32 are electrically coupled to each other by the conductor 18.

The ballast heater coils 38, 40 inductively provide power to the heater coils 16, 28 while the ballast power coils 42, 44 inductively provide power to the power coils 14, 32. The ballast power coils 42, 44 and the ballast heater coils 38, 40 are connected to the inverter 46, while the inverter 46 is connected to the power supply 48. The inverter 46 and the power supply 48 can be any known inverter and power supply gas discharge lamps. For example, the inverter 46 could be a two transistor half-bridge inverter.

In operation, the inverter 46 first supplies power to the ballast heater coils 38, 40 to warm the filaments 22, 24. After a predetermined time period, the inverter 46 reduces power to the ballast heater coils 38, 40, and energizes the ballast power coils 42, 44, causing an arc between the filaments 22, 24. After striking, the power supplied by the inverter 46 is reduced for steady state operation of the lamp 10.

Preheating of the filaments extends the life of the filaments, and thereby the lamp. The preheating current is typically the highest level of current the filaments experience. After preheat, the preheat current can be almost completely eliminated if full operating voltage is applied to the lamp.

Because the heater coils 16, 28 are coupled across filaments 22, 24, the heating of the filaments is separate from the power supplied to the filaments for maintenance of the arc in the lamp. Thus, a control circuit (not shown) is used to modulate the heating of the filaments for different situations. The construction and programming of the control circuit will be readily apparent to those in the art in view of this disclosure.

In the current embodiment, the control circuit enables dimming of the lamp. As is well known, a gas discharge lamp will extinguish if both the voltage between the filaments and the temperature of the filaments fall to levels incapable of sustaining the arc within the lamp. By heating the filament, it is possible to maintain the arc within the gas discharge lamp even if the potential between the two filaments is reduced.

During dimming of the lamp, the resonant circuit will function substantially off resonance to reduce the voltage across the lamp. By maintaining or increasing the filament heating current while reducing the lamp voltage, it is possible to have very low dimming levels. If additional stability or dimming range is needed due to difficult lamp types, the preheat can be increased as the lamp voltage is decreased to provide stable, non-flickering light.

Additionally, the heating of the filament during steady state operation could vary with the age of the lamp, thereby increasing the effective lifetime of the lamp. As the lamp ages the filaments sputter and deplate to the lamp wall. This substance on the lamp wall adsorbs the mercury and causes contamination. When the mercury is reduced or the lamp interior gases are contaminated, the lamp becomes hard to start and may adversely impact the lamp stability at the usual operating voltage. By sensing the lamp operating voltage, the control system can adjust to the changes in lamp impedance. For example, the system could change the heating profile for the lamp by increasing the preheat current or the duration of preheat when the lamp is determined to be difficult to start or unstable in the operating mode. The increase in time or preheat current will help in adjusting for the system instabilities.

The ballast power coil 44 and the ballast heater coil 38 are contained within the fixture connector 50. Similarly, the ballast power coil 42 and the ballast heater coil 40 are contained within the fixture connector 52.

Figure 4:
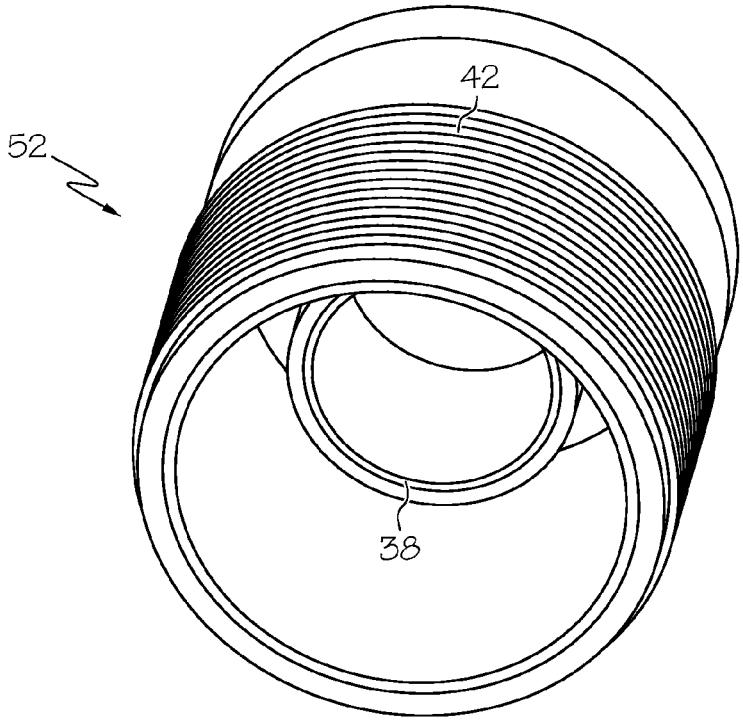
FIG. 4 shows a fixture connector for gas discharge lamp.

The fixture connector 52 is shown in FIG. 4. The fixture connector 52 consists of the ballast heater coil 40 coaxial with the ballast power coil 42. The ballast heater coil 40 and the ballast power coil 42 are coaxial. Thus, the fixture connector 52 slides over the inductive connector 12, thus placing the ballast heater coil 40 in proximity to the heater coil 28 and the ballast power coil 42 in proximity to the power coil 32.

As shown in FIG. 2, the power coil 14 is positioned circumferentially along the perimeter of the outer wall of the envelope 15. The power coil 14 could be on the interior of the envelope 15 or on the exterior of envelope 15. Heater coil 16 is placed either within or without a plateau 17 extending from the envelope 15. The plateau 17 is generally cylindrical and is coaxial with the outer wall portion 19 of the envelope 15. Configurations other than the coaxial arrangement of the ballast heater coil 38 and the ballast power coil 42 could be satisfactory. An example is shown in FIG. 5.

Figure 5:
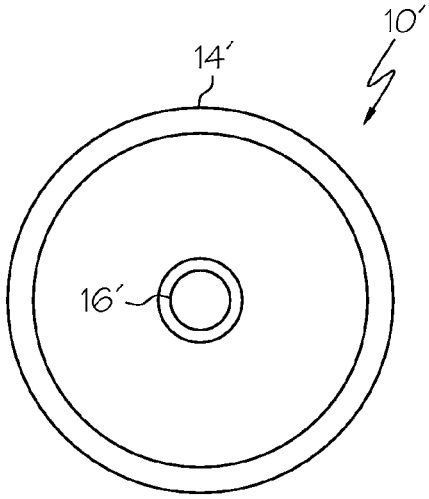
FIG. 5 shows an end view of a gas discharge lamp.

FIG. 5 shows an end view of an alternative embodiment 10' of the lamp where the power coil 14' and the heater coil 16' are coplanar and placed within the top of the envelope 15. Similarly, the fixture for the fixture connector would have a coplanar ballast power coil and a coplanar ballast heater coil.

Figure 6:
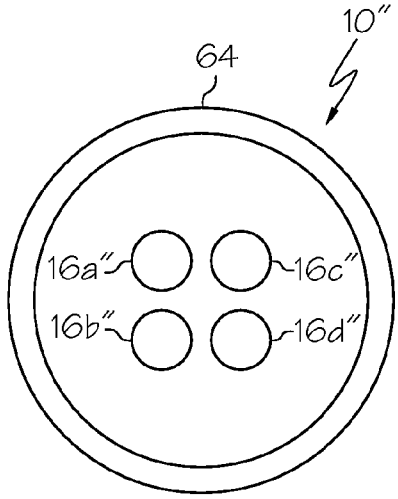
FIG. 6 shows an additional configuration of the coils for a gas discharge lamp.

FIG. 6 shows an end view of another alternative embodiment 10" of the lamp including multiple heating coils. The power coil 14" is located around the perimeter of the end of the lamp 10. The heater coils 16*a*", 16*b*", 16*c*", 16*d*" are located within the power coil 14". The power coil 14" and the heater coils 16*a*", 16*b*", 16*c*", 16*d*" are coplanar. In this configuration, the heater coils 16*a*", 16*b*", 16*c*", 16*d*" are connected in parallel with the lamp filaments.

Figure 7:
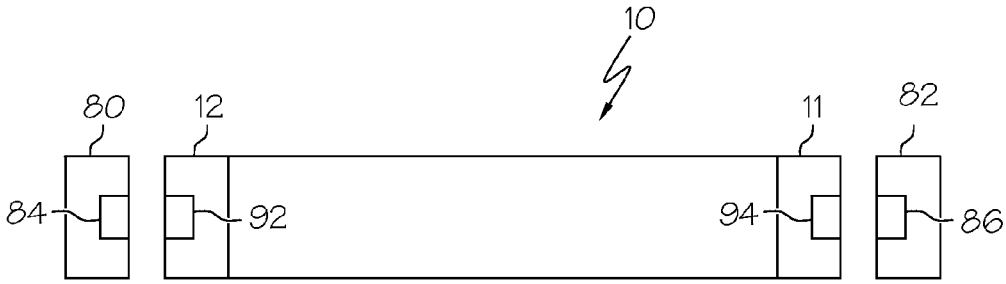
FIG. 7 shows a means for assisting the alignment of a gas discharge lamp.

FIG. 7 shows a means for holding the ballast power coil, ballast heater coil, heater coil and the power coil in alignment. The fixture connectors 80, 82 include the magnetic materials 84, 86. The inductive conductor sections 11, 12 contain the magnetic materials 92, 94. The magnetic materials 84, 86, 92, 94 are a combination of magnets and other magnet materials so as to cause the alignment.

Alternatively, or in addition to the magnets, the inductor conductor sections and the fixture connectors could be provided with an interlocking key mechanism. According to another embodiment, fixture connectors 80, 82 include springs or other elastic mechanisms that are adapted to hold lamp 10 in place relative to fixture connectors 80, 82. It would be obvious to those skilled in the art that many different mechanical means could be used to hold lamp 10 in place relative to fixture connectors 80, 82 such that ballast power coils 42, 44 are proximate power coils 32, 14 respectively, and ballast and ballast heater coils 40, 38 are proximate to heater coils 28, 16 respectively.

Figure 8:
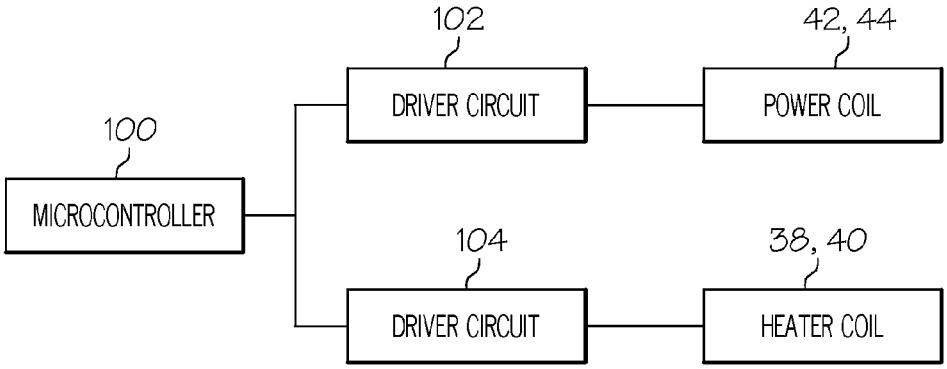
FIG. 8 shows a circuit for powering the inductively coupled gas discharge lamp.

FIG. 8 shows an alternative circuit configuration for powering the inductively coupled gas discharge lamp. In this configuration, the microcontroller 100 is coupled to, and controls, two driver circuits 102, 104. The driver circuit 102 is dedicated to the power coil 42, 44 while the driver circuit 104 is dedicated to the heater coil 38, 40. As the power supplied by the driver circuit 102 to the power coil 42, 44 is reduced, the driver circuit 104 increases the power to the heater coil 38, 40, thereby providing additional heating to the electrodes.

Figure 9:
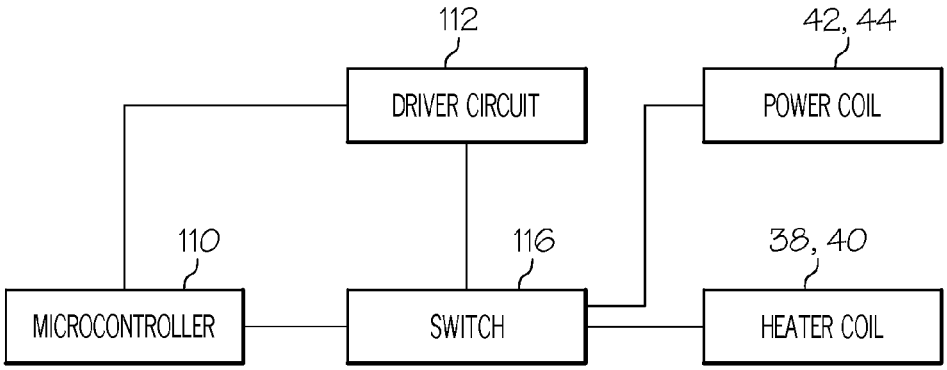
FIG. 9 shows a second circuit for powering the inductively coupled gas discharge lamp.

FIG. 9 shows another alternative circuit for powering the inductively coupled gas discharge lamp. The microcontroller 110 is coupled to, and controls, the driver circuit 112 and the switch 116. The switch 116 couples the power provided by the driver circuit 112 to the power coil 42, 44 and the heater coil 38, 40. The amount of power provided to the power coil 42, 44 or the heater coil 38, 40 is controlled by the microcontroller 110. As the amount of power provided to power coil 42, 44 is reduced, the amount of power supplied to heater coil 38, 40 is increased. The increased power to the heater coil 118 increases the temperature of the lamp electrodes.

The above descriptions are those of current embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The invention claimed is:

1. A fixture for an inductively powered gas discharge lamp, the gas discharge lamp having first and second electrodes, the fixture comprising:

a first fixture portion adapted to receive a first potion of the lamp, said first fixture portion having a first power coil adapted to supply power to the first electrode in order to operate the gas discharge lamp and a first heating coil adapted to supply power to the first electrode in order to heat the first electrode; and a second fixture portion adapted to receive a second potion of the lamp, said second fixture portion having a second power coil adapted to supply power to the second electrode in order to operate the gas discharge lamp and a second heating coil adapted to supply power to the second electrode in order to heat the second electrode where the first power coil is circumferentially disposed about the perimeter of the first portion.

2. The fixture of claim 1 where the second portion has a top, and the first heating coil is located on the top.

3. The fixture of claim 1 where the first heating coil is disposed about the perimeter of the second portion.

* * * * *

UNITED STATES PATENT AND TRADEMARK OFFICE

CERTIFICATE OF CORRECTION

PATENT NO. : 7,622,868 B2
APPLICATION NO. : 11/461475
DATED : November 24, 2009
INVENTOR(S) : David W. Baarman et al.

It is certified that error appears in the above-identified patent and that said Letters Patent is hereby corrected as shown below:

Column 6, Claim 1, Line 1:
"potion" should be --portion--

Signed and Sealed this

Ninth Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,622,868 B2
APPLICATION NO. : 11/461475
DATED : November 24, 2009
INVENTOR(S) : Baarman et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 306 days.

Signed and Sealed this

Twenty-sixth Day of October, 2010

David J. Kappos

David J. Kappos
*Director of the United States Patent and Trademark Office*